United States Patent [19]

Dumas

[11] 3,938,691

[45] Feb. 17, 1976

[54] NEWSPAPER CONTAINER

[76] Inventor: Sarah J. Dumas, 300 Brentwood Drive NE., Atlanta, Ga. 30305

[22] Filed: Aug. 2, 1974

[21] Appl. No.: 494,095

[52] U.S. Cl. ..... 220/94 A; 220/356

[51] Int. Cl.[2] ..... B65D 25/28

[58] Field of Search ..... 220/94 R, 94 A, 9 F, 215, 220/306, 352, 356, 71, 72, 73, 74, 83

[56] References Cited

UNITED STATES PATENTS

| | | | |
|---|---|---|---|
| 3,286,876 | 11/1966 | Ring | 220/73 |
| 3,290,021 | 12/1966 | Blachly et al. | 220/352 X |
| 3,372,834 | 3/1968 | Ayotte et al. | 220/306 |

*Primary Examiner*—William I. Price
*Assistant Examiner*—Steven M. Pollard
*Attorney, Agent, or Firm*—B. J. Powell

[57] ABSTRACT

A container for relatively heavy articles such as folded newspapers including a receptacle defining an article receiving chamber therein with an open mouth thereto, a pair of handles on opposite sides thereof, and reinforcing means in alignment with the handles to prevent the collapse of the receptacle as it is lifted; and, a closure for selectively closing the open mouth of the container and restraining the receptacle about the open mouth against outward flexing movement.

5 Claims, 13 Drawing Figures

NEWSPAPER CONTAINER

BACKGROUND OF THE INVENTION

Numerous plastic containers are available on the market today. When relatively heavy loads such as a stack of folded newspapers are placed in these containers, however, the side walls thereof have tended to collapse. Further, the closures or lids provided for these containers did not adequately support the side walls of the containers so that the closure was frequently dislodged as the container was lifted and the side walls collapsed.

SUMMARY OF THE INVENTION

These and other problems and disadvantages associated with the prior art are overcome by the invention disclosed herein by providing a container which does not collapse as it is lifted, even when relatively heavy loads such as a stack of folded newspapers are carried therein. Further, reinforcing means is provided in the receptacle at the lifting handles to prevent the side walls thereof from collapsing while keeping the container light weight. The closure for the receptacle prevents outward flexure of the side wall of the receptacle about the open mouth of the article receiving chamber therein so that the container is further strengthened and the closure is not dislodged as the container is lifted.

The apparatus of the invention includes a receptacle defining an article receiving chamber therein with an open mouth thereto. Lifting handles are provided on opposite sides of the receptacle on the side wall thereof. Those sections of the side wall at the handles are reinforced to strengthen the side wall while keeping the container light weight. A closure is provided for engaging the side wall about the open mouth to the chamber to close same and prevent outward flexure of the side wall as the container is lifted.

These and other features and advantages of the invention disclosed herein will become more apparent upon consideration of the following specification and accompanying drawings wherein like characters of reference designate corresponding parts throughout the several views and in which:

Figure 1:
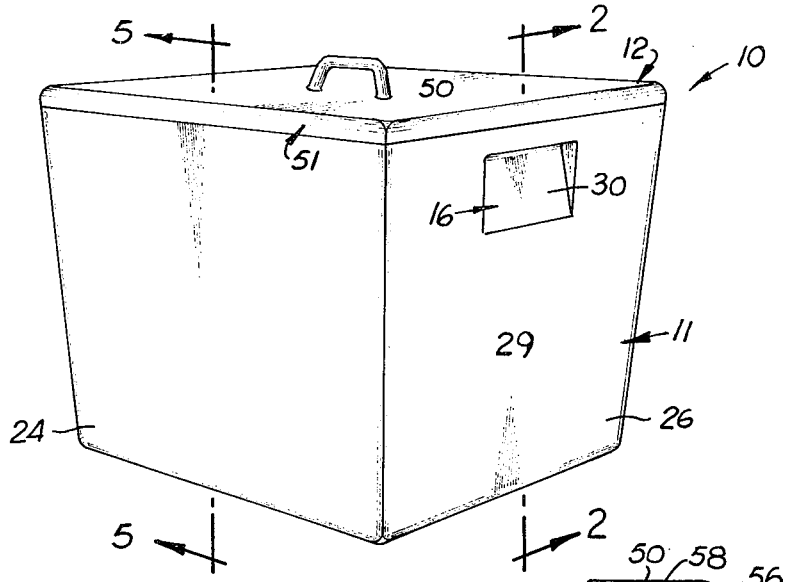
FIG. 1 is a perspective view illustrating one embodiment of the invention.

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Referring to FIGS. 1–5, a first embodiment of the container is illustrated and designated by the numeral 10. The container 10 comprises generally a receptacle 11 and a closure 12. The receptacle 11 defines an article receiving chamber 14 therein with an open mouth 15 thereto which can be selectively closed by closure 12. Lifting handles 16 are provided on opposite sides of receptacle 11 for use in manually lifting same.

Figure 2:
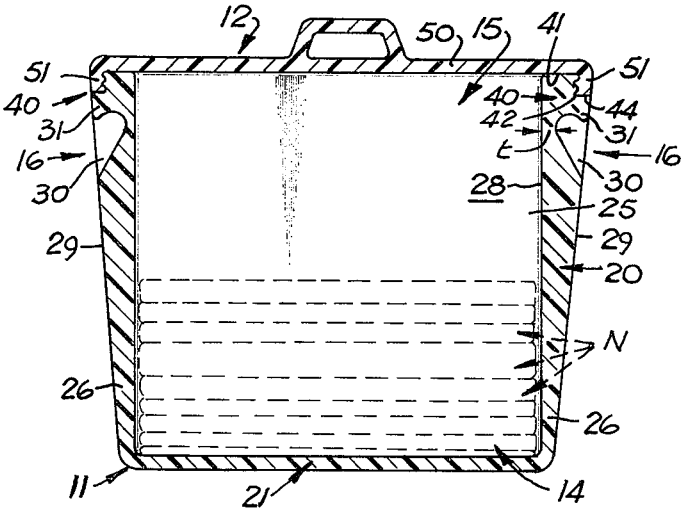
FIG. 2 is a cross-sectional view taken along line 2—2 in FIG. 1.
Figure 5:
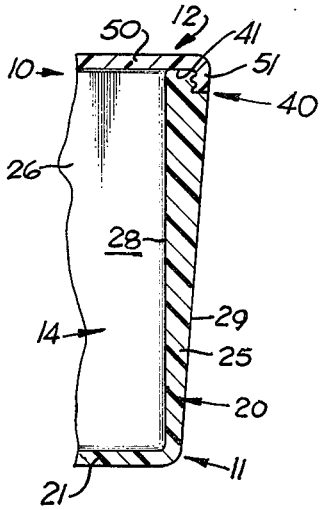
FIG. 5 is a partial cross-sectional view taken along line 5—5 in FIG. 1.
Figure 6:
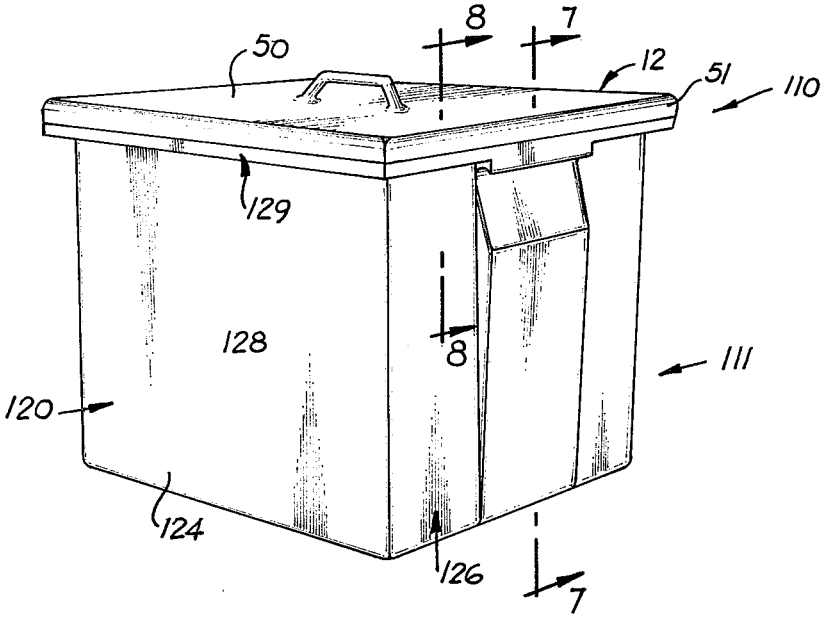
FIG. 6 is a perspective view illustrating a second embodiment of the invention.

The receptacle 11 as seen in FIGS. 2 and 5 includes an upstanding endless side wall 20 closed at its bottom by an integral bottom wall 21 so that the chamber 14 is defined within walls 20 and 21 and the open mouth 15 thereto is defined by the upper edge of side wall 20. While different configurations may be used, the side wall 20 defines a rectilinear chamber 14 therein with front wall portion 24, back wall portion 25 and end wall portions 26 connecting portions 24 and 25 and integral therewith. The wall portions 24–26 define generally vertical inside surfaces 28 and angled outside surfaces 29 so that each wall portion 24–26 tapers along its height. The thinnest section of each wall portion 24–26 is at its bottom and is integral with bottom wall 21 and the thickest section of each wall portion 24–26 is along the top edge thereof about the open mouth 15. Thus, it will be seen that the bottom wall 21 reinforces the bottom edges of wall portions 24–26 while the thicker sections of wall portions 24–26 reinforce same about their upper edges. Therefore, collapse of the wall portions 24–26 is prevented when the container 10 is lifted even though a relatively heavy load such as folded newspapers is carried in chamber 14.

Figure 4:
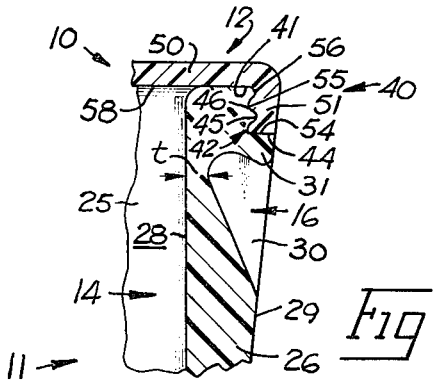
FIG. 4 is a view similar to FIG. 3 showing the closure in place on the receptacle.
Figure 3:
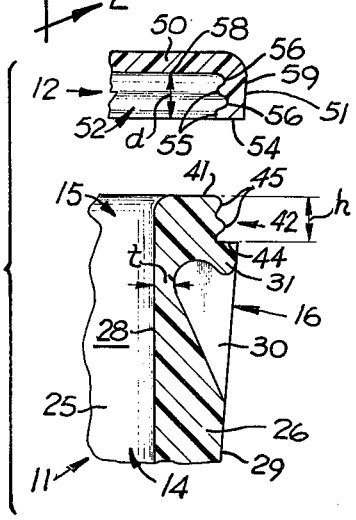
FIG. 3 is an enlarged portion of FIG. 2 showing the closure ready for placement on the receptacle.

As been seen in FIGS. 2–4, each of the end wall portions 26 has handle 16 therein centrally located across its width and adjacent the upper edge thereof. The handle 16 is formed by a pocket 30 in each end wall portion 26 which forms an arcuate shoulder 31 at its upper end adapted to be manually engaged to lift the container 10. The pocket 30 is sized so that a person's hand can be inserted therein sufficiently to engage the shoulder 31. The thickness t of end wall portion 26 at pocket 30 is sufficient to maintain the strength of end wall portion 26.

A closure retaining means 40 is provided at the upper edges 41 of wall portions 24–26 to maintain the closure 12 in place. The retaining means 40 as best seen in FIGS. 2–5 includes an upwardly and outwardly opening recess 42 formed in the wall portions 24–26 along their upper, outer corners. Recess 42 defines an arresting shoulder 44 along the lower edge thereof for engagement with closure 12 as will become more apparent. The inside generally vertical surfaces of recess 42 defines a pair of ridges 45 and valleys 46 therein adapted to engage the closure 12 as will become more apparent.

The closure 12 as seen in FIGS. 2–5 is a generally rectilinear member with a central rectilinear web 50 and an endless flange 51 depending therebelow defining a generally rectilinear recess 52 therein of a complimentary size and shape to the upper edge of receptacle 11 as will become more apparent. The recess 52 has a depth *d* substantially equal to the height *h* of the recess 42 around the upper edges 41 of the side wall 20 best seen in FIG. 3. The lower edge of flange 51 defines an abuttment 54 adapted to engage shoulder 44 of recess 42 as seen in FIG. 4. A pair of ridges 55 and valleys 56 complimentary to ridges 45 and valleys 46 on receptacle 11 are defined on the inside surface of flange 51 to mate with ridges 45 and valleys 46 as seen in FIG. 4 to maintain the closure 12 in place with abuttment 54 engaging shoulder 44 as seen in FIG. 4. The lower surface 58 of central web 50 engages the upper edges 41 of wall portions 24–26 when the closure 12 is fully seated on receptacle 11 as seen in FIGS. 2 and 5. It will also be noted that flange 51 is thicker at its juncture with web 50 than at abuttment 54 so as to reinforce flange 51. The outside surface 59 of flange 51 forms a continuation of the outside surface 29 of wall portions 24–26.

The closure 12 and receptacle 11 are illustrated made out of a resilient material such as plastic. This allows the closure 12 to be snapped onto receptacle 11 by the ridges 55 and valleys 56 on closure 12 resiliently engaging ridges 45 and valleys 46 on receptacle 11. Once the closure 12 is in place, the reinforced flange 51 thereof prevents the wall portions 24–26 from flexing outwardly and collapsing. The articles in chamber 14 such as the folded newspapers N seen by dashed lines in FIG. 2 prevent the wall portions 24–26 from collapsing inwardly.

SECOND EMBODIMENT

Referring to FIGS. 6–9, a second embodiment of the container is illustrated and designated by the numeral 110. The same closure 12 is used with container 110 and has the same reference numbers applied thereto. The container 110 is used similarly to container 10 and includes a receptacle 111.

Receptacle 111 defines an article receiving chamber 114 therein with an open mouth 115 thereto. Lifting handles 116 are provided on opposite sides of receptacle 111 for use in manually lifting the container 110.

Figure 8:
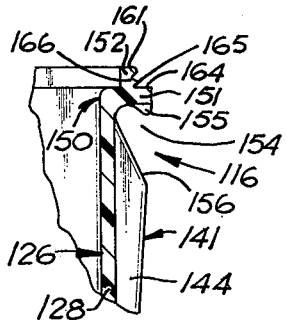
FIG. 8 is a partial cross-sectional view taken along line 8—8 in FIG. 6.
Figure 7:
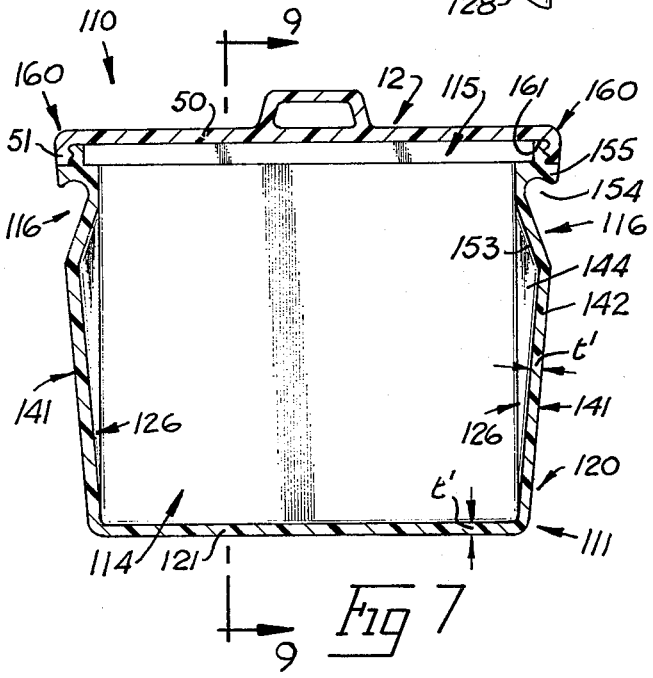
FIG. 7 is a cross-sectional view taken along line 7—7 in FIG. 6.
Figure 9:
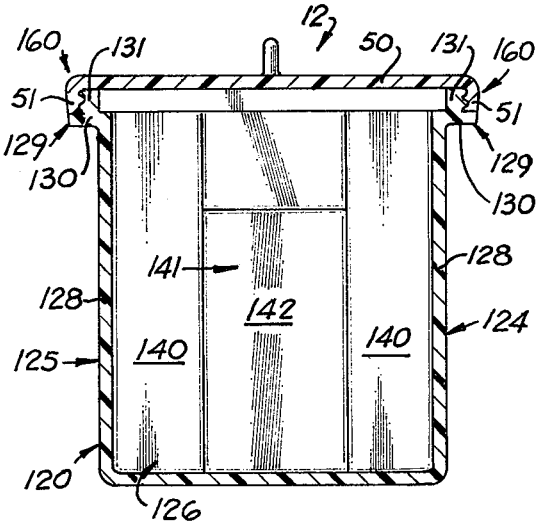
FIG. 9 is a partial cross-sectional view taken along line 9—9 in FIG. 7.

The receptacle 111 as best seen in FIGS. 7–9 includes an upstanding endless side wall 120 closed at its bottom by an integral bottom wall 121 so that chamber 114 is defined within walls 120 and 121 and the open mouth 115 is defined by the upper edge of side wall 120. It will be noted that the side wall 120 and bottom wall 121 have a generally constant thickness *t'*. The side wall 120 includes a front wall portion 124, a back wall portion 125, and end wall portions 126 joining front and back wall portions 124 and 125.

The front and back wall portions 124 and 125 include a generally vertically extending rectilinear plate 128 joined with the bottom wall 121 along their lower edges. An L-shaped flange 129 is provided along the upper edge of each of plates 128 with a generally outwardly extending horizontal leg 130 joined to the upper end of plates 128 along their upper edges at its inboard edge and a generally upstanding leg 131 joined to the horizontal leg 130 along its outboard edge.

As seen in FIGS. 7–9, each of the end wall portions 126 include a pair of spaced apart, generally vertically extending subplates 140 joined by an offset reinforcing section 141 therebetween. The offset section 141 includes a central web 142 which angles outwardly from subplates 140 starting at their juncture with bottom wall 121. Central web 142 is joined to the inboard edges of subplates 140 by a pair of tapered, generally outwardly extending side webs 144. The upper edges of subplates 140 and offset section 141 are provided with an L-shaped flange 150 similar to flange 129 with a horizontal leg 151 on opposite sides of offset section 141 and joined with the legs 130 on flanges 129. An upstanding leg 152 extends from the outboard end of leg 151 similarly to leg 131 on flange 129. The leg 152 extends from legs 131 to the offset section 141 as best seen in FIGS. 8 and 9.

Handles 116 are formed in offset section 141 as best seen in FIG. 7 and each handle 116 is located adjacent the upper end of section 141. The central web 142 curves inwardly and then outwardly as indicated at 153 to form a pocket 154 and a shoulder 155 at handle 116. Appropriate cutouts 156 are formed in the side webs 144 to complete handle 116.

A closure retaining means 160 is provided along the upper edges 161 of side flanges 129, end flanges 150 and offset sections 141 to maintain closure 12 in place. The retaining means 160 is best seen in FIGS. 7–9 and includes an upwardly and outwardly opening recess 162 formed in the upper, outer corners of upstanding legs 131 of flanges 129 upstanding legs 152 of flanges 150 and central web 142 of offset sections 141. Recess 162 defines an arresting shoulder 164 along the lower edge thereof similarly to shoulder 44 on receptacle 11. Ridges 165 and valleys 166 are formed at the inside edge of recess 161 to complimentarily engage ridges 55 and valleys 56 on closure 12 to hold it in place.

THIRD EMBODIMENT

Figure 10:
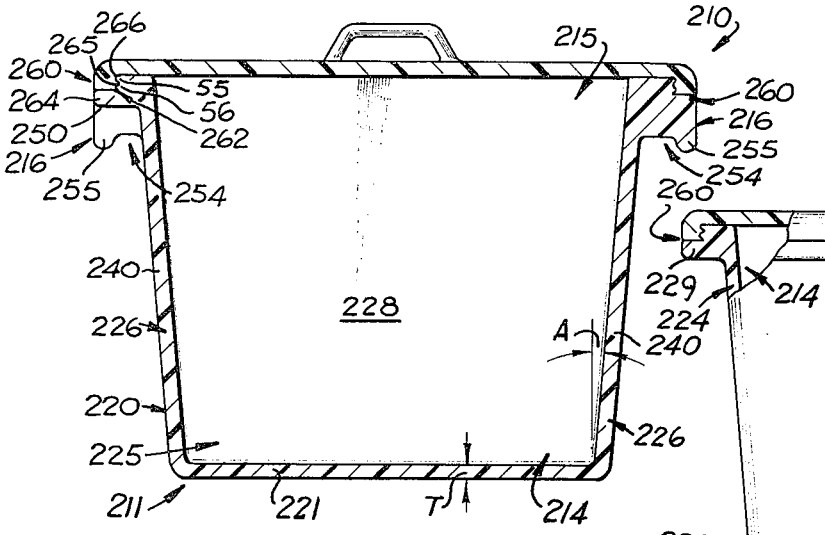
FIG. 10 is a cross-sectional view illustrating a third embodiment of the invention.
Figure 11:
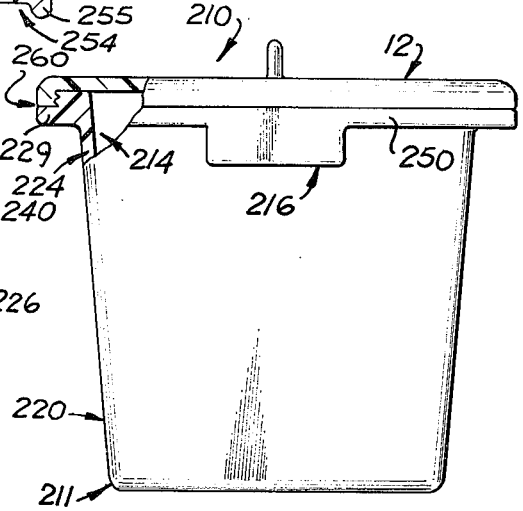
FIG. 11 is an end view of that embodiment of the invention seen in FIG. 10.

Referring to FIGS. 10 and 11, the third embodiment of the container is illustrated and designated generally by the number 210. The same closure 12 is used with container 210 and has the same referenced numerals applied thereto. The container 210 is used similarly to container 10 and includes a receptacle 211.

Receptacle 211 defines an article receiving chamber 214 therein with an open mouth 215 thereto. Lifting handles 216 are provided on opposite sides of the receptacle 211 for use in manually lifting the container 210. The receptacle 211 as best seen in FIGS. 10 and 11 includes an upstanding endless side wall 220 closed at its bottom by an integral bottom wall 221 so that chamber 214 is defined within wall 220 and 221 and the open mouth 215 is defined by the upper edge of side wall 220. It will be noted that side wall 220 and bottom wall 221 have a generally constant thickness T and the side wall 220 includes a front wall portion 224, back wall portion 225 and an end wall portion 226 joining front and back wall portions 224 and 225. It will further be noted that front, back and end wall portions 224, 226 all flare outwardly from the bottom wall 221 at a prescribed angle A as best seen in FIG. 10. This outwardly flaring angle A allows the receptacles 211 to be stacked within each other.

The front and back wall portions 224 and 225 each include a generally vertically extending rectilinear plate 228 joined with the bottom wall 221 along its lower edge. A flange 229 is provided along the upper edge of each of the plates 228 and extends outwardly therefrom generally horizontally.

Each of the end wall portions 226 includes an upwardly extending rectilinear plate 240 provided with an outwardly generally horizontally oriented flange 250 similar to flange 229. One of the handles 216 is formed below the flange 250 and centrally located with respect to the end wall 226 as seen in FIG. 11. Each handle 216 is integrally joined with both the underside of the flange 250 and the outside of the plate 240 which serves to reinforce the end wall 226 thereat. Each handle 216 is provided with a depending lip 255 at its outer end to form a pocket 254 thereunder that allows the handle 216 to be manually grasped to lift the container.

A closure retaining means 260 is provided along the upper edges 261 of the side flanges 229 and end flanges 250 to maintain closure 12 in place. The retaining means 260 is best seen in FIGS. 10 and 11 and includes an upwardly and outwardly opening recess 262 formed in the upper outer corners of flanges 229 and 250 so as to define an arresting shoulder 264 along the lower edge thereof similarly to shoulder 44 on receptacle 11. Ridges 265 and valleys 266 are formed on the inside edge of recess 261 to complimentarily engage ridges 55 and valleys 56 on closure 12 to hold it in place.

FOURTH EMBODIMENT

Figure 12:
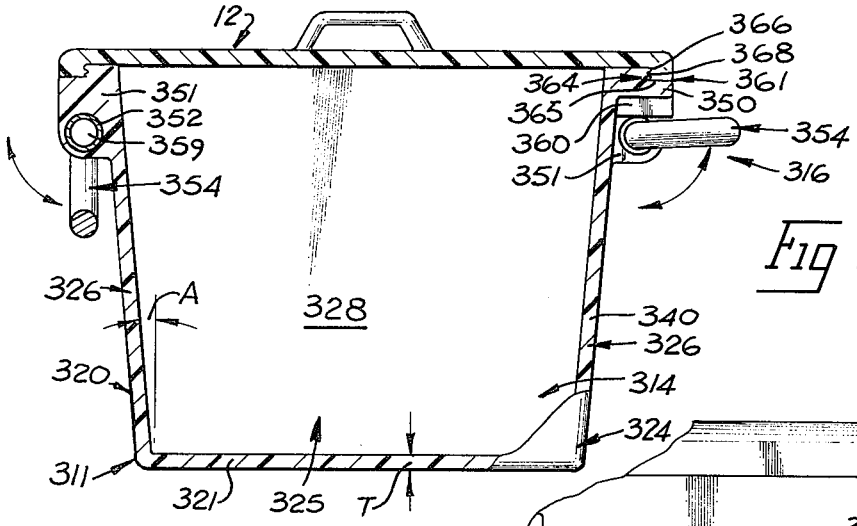
FIG. 12 is a cross-sectional view illustrating a fourth embodiment of the invention; and, FIG. 13 is an end view of that embodiment of the invention seen in FIG. 12.
Figure 13:
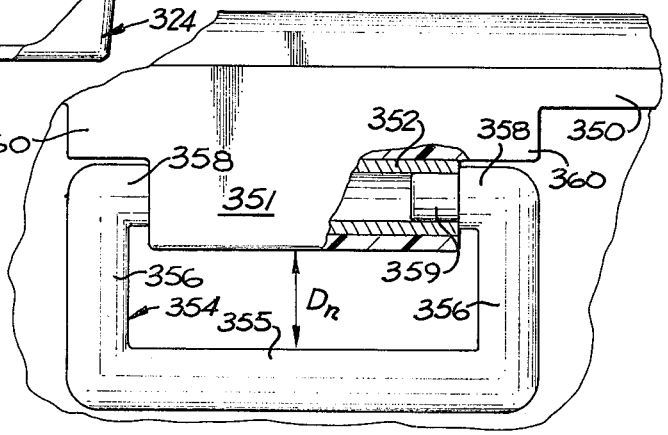

Referring to FIGS. 12 and 13, the fourth embodiment of the container is illustrated and designated generally by the number 310. The same closure 12 is used with container 310 and has the same reference numerals applied thereto. The container 310 is used similarly to container 10 and includes a receptacle 311.

Receptacle 311 defines an article receiving chamber 314 therein with an open mouth 315 thereto. Lifting handle assemblies 316 are provided on opposite sides of the receptacle 311 for use in manually lifting the container 310. The receptacle 311 as best seen in FIGS. 12 and 13 includes an upstanding endless side wall 320 closed at its bottom by an integral bottom wall 321 so that chamber 314 is defined within wall 320 and 321 and the open mouth 315 is defined by the upper edge of side wall 320. It will be noted that side wall 320 and bottom wall 321 have a generally constant thickness T and the side wall 320 includes a front wall portion 324, a back wall portion 325 and an end wall portion 326 joining front and back wall portions 324 and 325. It will further be noted that front, back and end wall portions 324–326 all flare outwardly from the bottom wall 321 at a prescribed angle A as best seen in FIG. 12. This outwardly flaring angle A allows the receptacles 311 to be stacked within each other.

The front and back wall portions 324 and 325 each include a generally upwardly extending rectilinear plate 328 joined with the bottom wall 321 along its lower edge. A flange is provided along the upper edge of each of the plates 328 and extends outwardly therefrom generally horizontally. Each of the end wall portions 326 includes an upwardly extending rectilinear plate 340 provided with an outwardly generally horizontally oriented flange 350 similar to flange 329.

One of the handle assemblies 316 is mounted below flange 350 centrally located with respect to the end wall 326 as seen in FIG. 13. Handle assembly 316 includes a bearing block 351 integrally joined with both the underside of flange 350 and the outside of plate 340 of end wall 326 to reinforce the end wall. A bushing 352 is positioned in bearing block 351 and pivotally mounts a generally U-shaped handle 354 therein. Handle 354 includes a central leg 355 with upstanding side legs 356 at opposite ends thereof. The upper ends of side legs 356 are provided with inwardly directed stub legs 358 that have opposed aligned reduced diameter bearing portions 359 pivotally received in opposite ends of bushing 352 as seen in FIG. 13. Thus, it will be seen that the central leg 355 is located a prescribed distance $D_n$ below bearing block 351 to allow section 355 to be manually grasped and pivoted outwardly and upwardly. Laterally extending abuttments 360 are provided on opposite ends of bearing block 351 and overlie the side legs 356 when they are pivoted upwardly. Abuttments 360 arrest the upward movement of the handle 354 so that it is generally horizontal to facilitate the lifting of container 310. When handle 354 is released, its weight causes the handle to swing back to a retracted, generally vertical position as shown in FIG. 12.

A closure retaining means 361 is provided along the upper edges 362 of the side flanges 329 and end flanges 350 to maintain closure 12 in place. The retaining means 361 is best seen in FIGS. 12 and 13 and includes an upwardly and outwardly opening recess 364 formed in the upper outer corners of flanges 329 and 350 so as to define an arresting shoulder 365 along the lower edge thereof similarly to shoulder 44 on receptacle 11. Ridges 366 and valleys 368 are formed on the inside edge of recess 362 to complimentarily engage ridges 55 and valleys 56 on closure 12 to hold it in place.

The various embodiments of the container are made of a waterproof material such as plastic. The interconnection between the cover and receptacle provides a watertight seal so that the container may be used indoors or outdoors while preventing undue moisture pickup of the contents of the container such as newspapers. If a moldable plastic material is used, the cover or receptacle can be made economically in a one step molding process.

While specific embodiments of the invention have been disclosed herein, it is to be understood that full use of modifications, substitutions and equivalents may be made without departing from the scope of the inventive concept as disclosed herein.

I claim:

1. A container comprising a receptacle defining an article receiving chamber therein having an open mouth thereto including a side wall including a front wall portion, a rear wall portion and a pair of end wall portions joining said front and end wall portions, a pair of handles on said end walls on opposite sides of said receptacle, and reinforcing means for strengthening said side wall in alignment with said handles to prevent collapse of said receptacle as it is lifted by said handles, said reinforcing means defining an offset section in each of said end wall portions and including a central web angled outwardly from said end wall portion and a pair of side webs joining opposite sides of said central web to said end wall portions; and a closure constructed and arranged to engage said side wall to close said open mouth of said chamber and restrain said side wall about said open mouth against outward movement.

2. The container of claim 1 further including a reinforcing flange along the upper edges of said front, rear, and end wall portions.

3. The container of claim 2 further including a closure constructed and arranged to engage said side wall to close said open mouth of said chamber and restrain said side wall about said open mouth against outward movement, said receptacle further defining a closure receiving recess along said reinforcing flange and retaining means at said closure receiving recess for maintaining said closure on said receptacle.

4. The container of claim 1 further including retaining means for maintaining said closure in place on said receptacle.

5. The container of claim 6 wherein said reinforcing means includes a bearing block and an abuttment integral with opposite ends of said bearing block, and wherein said handle includes a bushing carried by said bearing block and a generally U-shaped member pivotally carried by said bushing, said U-shaped member constructed and arranged to engage said abuttments upon upward and outward pivotal movement to limit such movement so that said member is generally horizontal.

* * * * *